US005761984A

United States Patent [19]

Goellner et al.

[11] Patent Number: 5,761,984

[45] Date of Patent: Jun. 9, 1998

[54] BRAKING DEVICE FOR A FLUID POWER ACTUATOR

[75] Inventors: Willy J. Goellner; Miodrag M. Mihajlovic, both of Rockford, Ill.

[73] Assignee: Advanced Machine & Engineering Co., Rockford, Ill.

[21] Appl. No.: 813,874

[22] Filed: Mar. 7, 1997

[51] Int. Cl.[6] ..... F15B 15/26

[52] U.S. Cl. ..... 92/21 MR; 92/24; 92/28; 91/41

[58] Field of Search ..... 92/61, 15, 21 R, 92/21 MR, 19, 23, 24, 27, 28, 41

[56] References Cited

U.S. PATENT DOCUMENTS

| | | | |
|---|---|---|---|
| 2,632,425 | 3/1953 | Grover | 92/28 |
| 2,988,058 | 6/1961 | Warnecke | 92/28 |
| 3,470,793 | 10/1969 | Hanchen | 92/24 X |
| 3,911,141 | 10/1975 | Robert | 92/24 X |
| 4,537,113 | 8/1985 | Stoll et al. . | |
| 4,550,811 | 11/1985 | Rumsey | 92/21 MR X |
| 4,856,411 | 8/1989 | Maurer et al. | 92/28 X |
| 4,890,541 | 1/1990 | Spooner . | |
| 5,137,400 | 8/1992 | Sagara et al. . | |
| 5,540,135 | 7/1996 | Goellner | 92/28 X |

*Primary Examiner*—Hoang Nguyen
*Attorney, Agent, or Firm*—Vernon J. Pillote

[57] ABSTRACT

A fluid pressure operated braking device for a piston rod. The braking device includes a clamp sleeve and a cam member spring biased axially in a direction to actuate the clamp sleeve to a clamp condition, and a fluid pressure operator that provides a hydraulically amplified force for moving the cam member in opposition to the spring to release the clamp sleeve. The fluid pressure operator includes a first piston operated in response to fluid pressure applied thereto to produce a force correlative with fluid pressure and the first piston is connected to a second piston that pressurizes a non-compressible fluid in a closed pressure chamber communicating with a third piston, and a third piston actuates the cam ring in opposition to the spring to release the clamp ring. The second piston has a cross-sectional area that is smaller than the cross-sectional area of the first and second piston such that the second piston is operated in response to actuation by the first piston, to pressurize the fluid in the closed pressure chamber to a pressure substantially higher than the pressure of the fluid supplied to the first piston.

17 Claims, 1 Drawing Sheet

BRAKING DEVICE FOR A FLUID POWER ACTUATOR

BACKGROUND OF THE INVENTION

Various devices have heretofore been made for clamping the piston rod of the linear fluid actuator against axial movement, to hold the rod in the position in which it has been moved by the linear actuator when pressure to the actuator is shut off or, in the event of failure of the pressure supply to the linear actuator. In general, such devices include a clamp sleeve that is radially contractible to grip the piston rod passing therethrough, and a cam ring that is movable axially relative to the clamp ring between the clamp position and a release position. The cam ring is spring urged axially in a direction to actuate the clamp sleeve to a clamp condition, and a fluid pressure operator is provided for moving the cam ring in opposition to the springs to a release condition. The holding force of the rod clamp varies with the diameter of the piston rod and the size of the fluid operator and the fluid pressure available for operating the rod clamp, and problems have been encountered in providing satisfactory holding force at low operating pressures, particularly on rod clamps for small size cylinders having small rods.

Some rod braking devices use a single piston to directly actuate the cam ring to a release condition and others such as disclosed in U.S. Pat. Nos. 5,137,400 and 5,540,135, use multiple fluid operated pistons to enhance the clamping action. Some other rod braking devices such as disclosed in U.S. Pat. Nos. 4,537,113 and 4,890,541, use a cam and ball type force intensifier between the fluid pressure operator and the cam ring, to increase the axial force on the cam ring and enhance the clamping action of the clamp sleeve.

SUMMARY OF THE INVENTION

It is a general object of the present invention to provide a fluid pressure operated braking device for a piston rod which can provide high clamping force for holding the rod against axial movement and which amplifies the force of the fluid pressure operator to effect reliable release of the braking device.

Another object of the present invention is to provide a braking device for a piston rod of a linear fluid pressure actuator, which can provide high rod clamping and release forces in a housing having a diameter generally corresponding to that of the linear fluid actuator.

The present invention accomplishes the above objects, among others, by providing a braking device having a clamp sleeve and a cam member spring biased axially in a direction to actuate the clamp sleeve to a clamp condition, and a fluid pressure operator that provides a hydraulically amplified force for moving the cam member in opposition to the spring to release the clamp sleeve. The fluid pressure operator includes a first piston operated in response to fluid pressure applied thereto to produce a force correlative with the fluid pressure; the force of the first piston is transmitted to a second piston that pressurizes a non-compressible fluid in a closed pressure chamber communicating with a third piston, and the third piston actuates the cam ring in opposition to the spring to release the clamp ring. The second piston is configured to have a cross-sectional area that is substantially less than the cross-sectional area of the first and second pistons such that the second piston is operative in response to actuation by the first piston, to pressurize the fluid in the closed pressure chamber to a pressure substantially higher than the pressure of the fluid supplied to the first piston.

In accordance with another aspect of the present invention, provision is made for manually pressurizing the fluid in the closed pressure chamber, to enable the braking device to be selectively released manually in the event of failure of the fluid pressure supply.

In accordance with another aspect of the invention, provision is made for visually indicating whether the clamp device is in a clamp or release condition.

DETAILED DESCRIPTION

Figure 2:
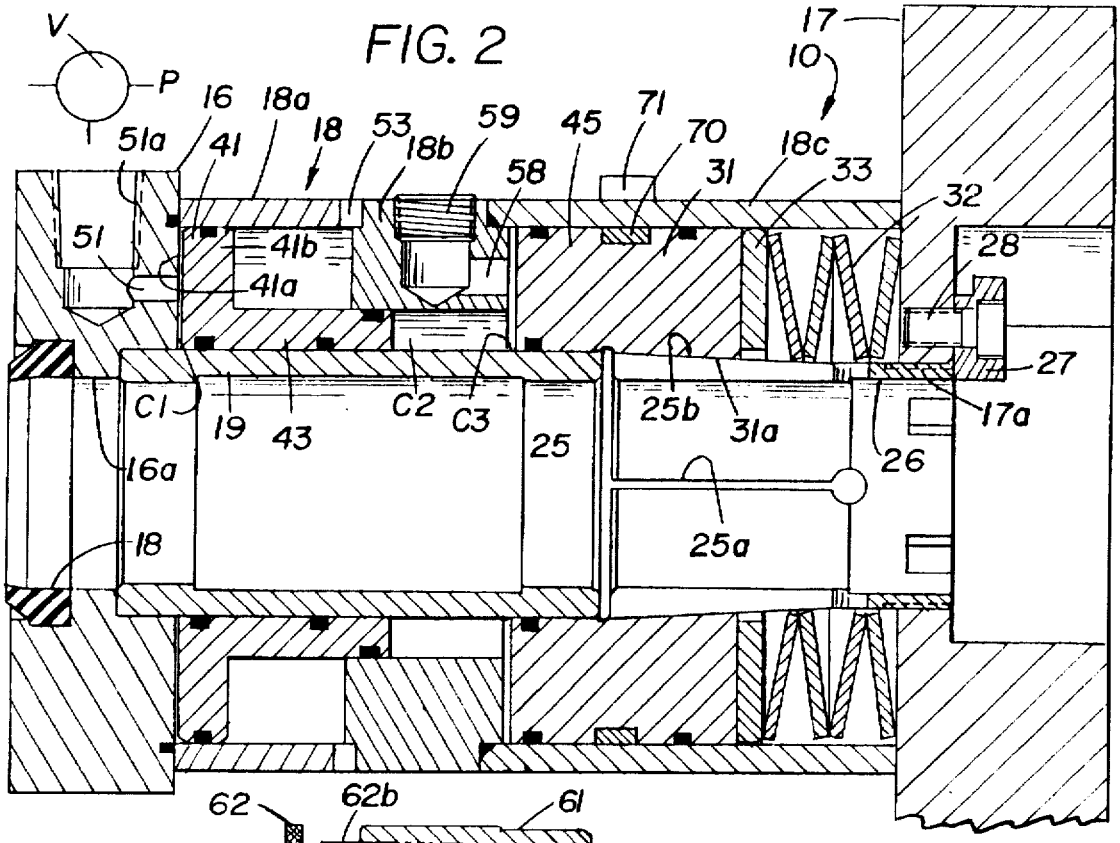
FIG. 2 is a longitudinal sectional view through the braking device, on a larger scale than FIG. 1.

The present invention relates to a braking device 10 for linear fluid actuator 11 for holding the piston rod in a position to which it has been moved by the fluid actuator. As is conventional, the fluid actuator 11 includes an actuator cylinder 12 having a cylinder head 13 and a piston rod 14 extending out of the cylinder through the cylinder head. The linear fluid actuators can be of the single or double acting type, and the size of the fluid actuator is selected such that the available operating fluid pressure acting on the piston area is sufficient to move the piston rod under the loads to be moved by the actuator. The braking device is provided to clamp and hold the piston rod in the position to which it is adjusted by the fluid actuators, and prevent movement of the piston rod by the load, when the fluid power to the actuator is shutoff or in the event of a failure of the source of fluid pressure supply.

The braking device includes a housing having first and second end walls 16 and 17, an outer casing 18 extending between the end walls, and an inner casing 19 mounted on the end wall 16. The end wall 17 is attached to the cylinder head 13 at the rod end of the fluid actuator as by bolts, and the end walls 16 and 17 have openings **16*a* and 17*a* to allow passage of the piston rod 14 through the housing. A resilient wiper ring 18 is preferably provided on the end wall 16 to inhibit entrance of foreign matter into the braking device during retraction of the piston rod. The inner casing 19 is dimensioned to extend around the piston rod and a clamp sleeve 25 is disposed around the piston rod at a location between the inner casing 19 and the second end wall 17. The clamp sleeve is radially contractible into engagement with the piston rod and in the embodiment shown, the clamp sleeve has lengthwise extending slots 25*a* that facilitate radial expansion and contraction. In the preferred embodiment illustrated, the clamp sleeve has an annular end portion 26 which is threadedly mounted in the opening 17*a* in the end wall 17, to enable axially adjustment of the clamp sleeve relative to the end wall. A stop member 27 configured to engage notches 26*a* in the sleeve end portion 26, is detachably mounted on the second end wall by fasteners 28**, to hold the clamp sleeve in adjusted position.

The clamp sleeve 25 has a tapered outer surface **25*b* and an annular cam member or cam ring 31 extends around the clamp sleeve and has a tapered inner surface 31*a* complimentary to the tapered outer surface of the sleeve. The cam member 31 is yieldably urged by springs 32, herein shown as disk springs, in a direction to actuate the clamp ring into clamping engagement with the rod. A retainer disk 33 is disposed at one end of the cam ring 31 and the springs 32 are interposed between the retainer disk and the second end wall 17 of the brake housing. The springs 32 are selected to apply an axial force to the cam ring 31 sufficient to cam the clamp sleeve 25** into engagement with the piston rod and hold the piston rod against axial movement under outside forces imposed on the piston rod.

The brake device is arranged to be actuated by fluid pressure to a release condition. It is desirable that the brake device have a cross-sectional size generally corresponding to the cross-sectional size of the linear fluid actuator and this limits the cross-sectional area available for a fluid pressure operated piston in the brake device to a value substantially less than the cross-sectional area of the working end of the piston in the fluid actuator. The inner and outer casings 18 and 19 include portions configured to provide an annular first cylinder C1 contiguous to the first end wall 16, and having a first cross-sectional area; portions configured to provide an annular second cylinder C2 contiguous to the first cylinder and having a second cross-sectional area substantially smaller than the cross-sectional area of the cylinder C1, and portions configured to provide an annular third cylinder C3 contiguous to and communicating with the second cylinder and having a cross-sectional area substantially greater than the cross-sectional area of the cylinder C2. In the preferred embodiment illustrated, the outer casing 18 includes a first section 18*a*, a second or intermediate section 18*b* and a third section 18*c*. The first and third sections preferably have the same inner and outer diameters and the intermediate section has an inner diameter substantially smaller than the inner diameter of the first and third sections 18*a* and 18*c*.

A first piston 41 is disposed in the first cylinder C1 and has a sliding seal with the portions of the inner an outer casings that form the first cylinder C1. Piston 41 has a first end face 41*a* juxtaposed to the first end wall 16 of the housing, and a second annular piston 43 is provided at a second end face of the first piston and has a sliding seal with the inner casing and with the intermediate portion 18*b* of the outer casing. The first piston is arranged to actuate the second piston and the second piston is preferably fixed to or formed integrally with the first piston. A third piston 45 is disposed in the third cylinder C3 and has a sliding seal with the inner casing and the outer casing section 18*c*. The third piston 45 is arranged to actuate the cam ring in opposition to the springs 32 to actuate the clamp sleeve to a release condition. In the preferred embodiment illustrated, the piston is formed integrally with the cam ring 31.

A passage 51 is provided in the first end wall 16 for passing fluid to the cylinder C1 at the first side 41*a* of the first piston 41 and passage 51 is adapted for connection as by the threaded portion 51*a* to an external source of fluid under pressure designated P, which may be the same source of fluid pressure used for the linear fluid actuator 11. A valve V may be provided to enable selective actuation of the braking device. The cylinder at the second side of the piston 41*b* is vented to atmosphere as indicated at 53. Thus, when fluid pressure is supplied through passage 51 to the cylinder C1, the first piston 41 is pressure actuated toward the second cylinder C2 with a force determined by the fluid pressure and the area of piston 41. The housing is configured to provide a closed pressure chamber between the second piston 43 and the third piston 45 in the second and third cylinders C2 and C3, and the closed pressure chamber is filled with a substantially non-compressible fluid. The non-compressible fluid is preferably a silicone fluid, for example a silicone fluid marketed by Dow Corning Corporation under the designation Dow Corning 200 fluid, 1000cst. As shown, the outer casing section 18*c* is sealed to the intermediate cylinder section 18*b* as indicated at 55, and a fill passage 58 in the intermediate cylinder section 18*b* is closed by a plug 59. The second piston 43 is configured to have a cross-sectional area substantially less than the cross-sectional area of the first piston 41 so that the second piston pressurizes the fluid in the closed pressure chamber to a pressure substantially higher than the pressure of the actuating fluid supplied to the first cylinder C1 at the end face 41*a* of the first piston. The third piston 45 has a cross-sectional area substantially greater than the cross-sectional area of the second piston and preferably the same as the cross-sectional area of the end face 41*a* of the first piston. The force applied to the third piston for moving the cam ring to release the clamp sleeve is thus substantially higher than the force applied by the first piston in response to the fluid pressure supplied thereto. The cross-sectional area of the second piston is preferably less than one-third of the cross-sectional area of the first and second pistons, to provide a hydraulic force amplification of three or more and it is contemplated that the second piston area can be selected in relation to the first piston area to provide a maximum amplification ratio of 1 to 6.

Figure 3:
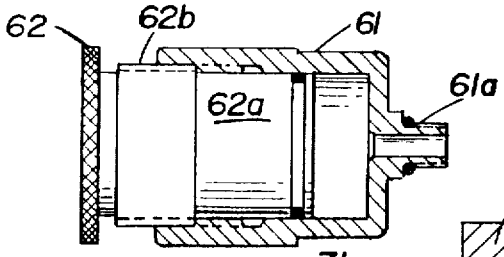
FIG. 3 is a view shown partially in section of a manually operable fluid pressurizing device for manually actuating the braking device to a release condition.
Figure 1:
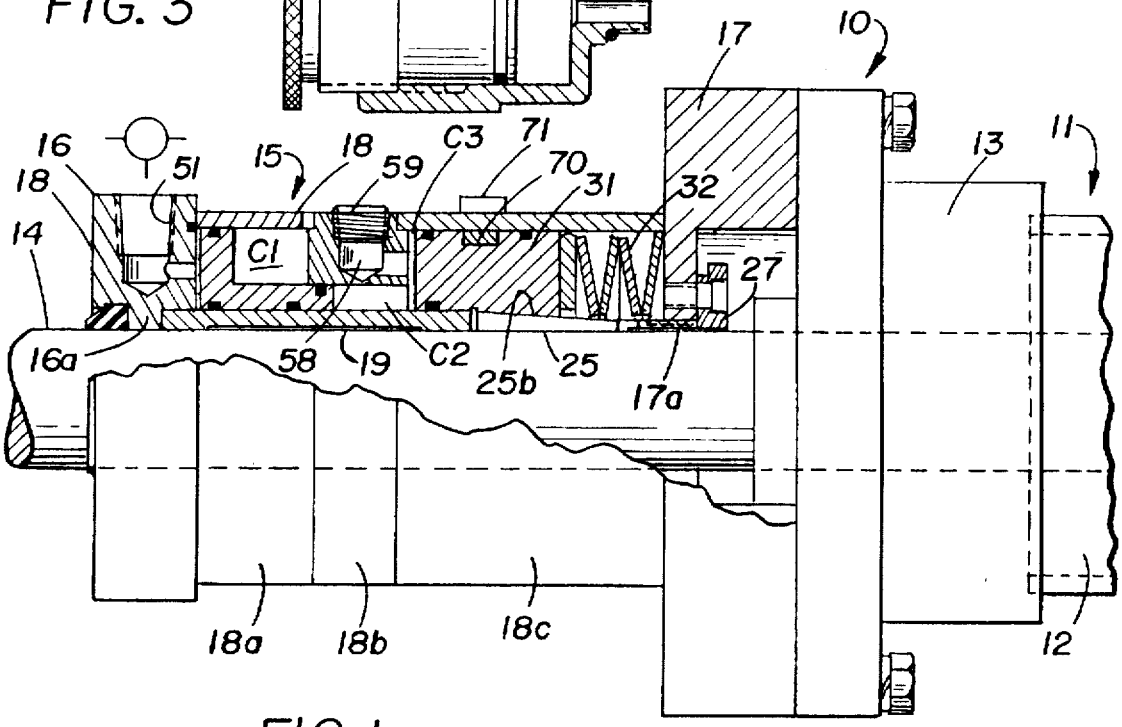
FIG. 1 is a fragmentary side view of a linear fluid actuator having the braking device applied thereto, with parts of the braking device shown in section.

In some installations, it is desirable to enable manual actuation of the brake device to release the piston rod of the fluid actuator, in the event of failure of the fluid pressure supply P. As shown in FIG. 3, a cup 61 has a threaded end portion 61*a* adapted to be threaded into the outer end of passage 58. A member 62 includes a piston portion 62*a* having a slidable seal in the cup and a threaded portion 62*b* threaded into the cup. The cup 61, filled with the same non-compressible fluid as provided in the closed chamber, can be threaded into the fill opening 58 after removal of the plug 59. Thereafter, the member 62 can be manually turned into the cup to pressurize the fluid in the closed pressure chamber and effect manual operation of the cam ring to a release condition.

A piston position sensor is advantageously provided for indicating when the brake apparatus is in or out of a clamp condition. For this purpose, cylinder portion 18*c* is formed of a non-magnetic material such as aluminum and a magnetic tape 70 provided in a groove in the clamp ring. A magnetic responsive position sensor 71 is mounted on the outer side of the casing section 18*c*, and senses the magnetic tape 70.

From the foregoing it is believed the construction and operation of the brake device will be readily understood. The second piston has a cross-sectional area much smaller than the cross-sectional area of the first piston such that the second piston pressurizes the non-compressible fluid in the closed pressure chamber between the second and third pistons to a pressure much higher than the external fluid pressure applied to the first piston. This enables reliable operation of the cam ring to release the clamp ring at relatively low pressure on the external operating fluid.

The embodiments of the invention in which an exclusive property or privilege is claimed are defined as follows:

1. A braking device for the piston rod of a linear fluid actuator comprising a clamp sleeve having a tapered outer surface and an annular cam member having a tapered inner surface around the clamp sleeve, spring means urging the cam member axially in a first direction to actuate the clamp sleeve to a clamp condition, a housing having a rod receiving passage extending therethrough, the housing including means providing a first cylinder disposed around the passage, means providing a second cylinder disposed around the passage and axially contiguous to the first cylinder, and means providing a third cylinder disposed around the passage and axially contiguous to the second cylinder, a first piston slidable in the first cylinder and having a first side facing away from second cylinder and a second side facing toward the second cylinder, a second piston actuated by the first piston and slidable in said second cylinder, a third piston slidable in said third cylinder and operative to move the cam member in a second direction to release the clamp sleeve, passage means for passing pressurized actuating fluid to and from the first cylinder at the first side of the first piston, the housing being configured to provide a closed pressure chamber between the second and third pistons in the second and third cylinders, the closed pressure chamber being filled with a substantially non-compressible fluid, the second piston being configured to have a cross-sectioned area that is substantially less than the cross-sectional area of the first piston and such that the second piston is operative in response to actuation by the first piston to pressurize the fluid in the closed pressure chamber to a pressure substantially higher than the pressure of the actuating fluid supplied to the first cylinder, the third piston being configured to have a cross-sectional area greater than the cross-sectional area of the second piston.

2. A braking device according to claim 1 wherein the second piston is integral with the first piston.

3. A braking device according to claim 2 wherein the third piston is integral with the cam member.

4. A braking device according to claim 1 including manually operable means for pressurizing the fluid in the closed chamber to move the cam member to a released condition.

5. A braking device for the piston rod of a linear fluid actuator comprising a clamp sleeve having a tapered outer surface, an annular cam member having a tapered inner surface around the clamp sleeve, spring means urging the cam ring axially in a first direction to actuate the clamp sleeve to a clamp condition, a brake housing including:

(a) first and second end walls having axially aligned openings, (b) an annular first cylinder contiguous to the first end wall having inner and outer walls radially spaced to provide a first cross-sectional area therebetween, (c) an annular second cylinder contiguous to first cylinder and having inner and outer walls radially spaced to provide a second cross-sectional area therebetween substantially smaller than the first cross-sectional area, (d) an annular third cylinder contiguous the second cylinder and having inner and outer walls radially spaced to provide a third cross-sectional area therebetween substantially larger than the second cross-sectional area, an annular first piston having a sliding seal with the inner and outer walls of the first cylinder and a first end face juxtaposed to the first end wall, an annular second piston at the side of the first piston opposite the first end face having a sliding seal with the inner and outer walls of the second cylinder and a cross-sectional area substantially smaller than the first cross-sectional area, an annular third piston having a sliding seal with the inner and outer walls of the third cylinder and a cross-sectional area substantially greater than the cross-sectional area of the second piston and operative to move the cam ring in a second direction to release the clamp member passage means for passing pressurized actuating fluid to the first cylinder at the first end face of the first piston, the housing being configured to provide a closed pressure chamber between the second and third pistons in the second and third cylinders, the closed pressure chamber being filled with a substantially non-compressible fluid, the second piston being configured to have a cross-sectional area that is substantially less than the cross-sectional area of the first piston and such that the second piston pressurizes the fluid in the closed pressure chamber to a pressure substantially higher than the pressure of the actuating fluid supplied to the first cylinder, the third piston being, configured to have a cross-sectional area substantially greater than the cross-sectional area of the second piston.

6. A braking device according to claim 5 wherein the second piston is integral with the first piston.

7. A braking device according to claim 5 wherein the third pistons integral with the cam member.

8. A braking device according to claim 5 wherein the clamp sleeve has an end portion mounted on the second end wall for axial adjustment relative to the second end wall.

9. A braking device according to claim 5 wherein the clamp sleeve has an annular end portion threaded into the opening in the second end wall for axial adjustment relative to the second wall.

10. A braking device according to claim 9 including means for locking the clamp sleeve against turning relative to the second end wall.

11. A device for braking the piston rod of a linear fluid actuator comprising, a brake housing including:

(a) first and second end walls having axially aligned openings for passage of a rod through the housing, (b) an outer casing extending between the end walls, (c) an inner casing in the outer adjacent the first end wall, the inner and outer casings including:

(d) first portions configured to provide an annular first cylinder contiguous to the first end wall having a first cross-sectional area, (e) second portions configured to provide and annular second cylinder contiguous to the first cylinder and having a second cross-sectional area substantially smaller than the first cross-sectional area, (f) third portions configured to provide an annular third cylinder contiguous to the second cylinder and having a cross-sectional area substantially greater than the second cross-sectional area, an annular first piston having a sliding seal with the first portions of the inner and outer casings and a first end face juxtaposed to the first end wall, an annular second piston at a side of the first piston opposite the first end face and having a sliding seal with the second portions of the inner and outer casings, an annular third piston having a sliding seal with the third portions of inner and outer casings, a clamp sleeve disposed in the outer casing contiguous to the second end wall and having a tapered outer surface, a cam ring around the clamp sleeve and having a tapered inner surface, spring means yieldably urging the cam ring in a first direction to actuate the clamp sleeve to a clamp condition, the third piston being configured to move the cam ring in a second direction to actuate the clamp sleeve to a release condition, passage means for passing pressurized actuating fluid to and from the first cylinder at the first end face of the first piston, the housing being configured to provide a closed pressure chamber between the second and third pistons in the second and third cylinders, a closed pressure chamber being filled with a substantially non-compressible fluid, the second piston being configured to have a cross-sectional area that is substantially less than the cross-sectional area of the first piston and such that the second piston pressurizes the fluid in the closed pressure chamber to a pressure substantially higher than the pressure of the actuating fluid supplied to first cylinder, the third piston being configured to have a cross-sectional area substantially greater than the cross-sectional area of the second piston.

12. A braking device according to claim 11 wherein the second piston is integral with the first piston.

13. A braking device according to claim 11 wherein the third piston is integral with the cam member.

14. A braking device according to claim 11 wherein the clamp sleeve has an end portion mounted on the second end wall for axial adjustment relative to the second end wall.

15. A braking device according to claim 11 wherein the clamp sleeve has an annular end portion threaded into the opening in the second end wall for axial adjustment relative to the second end wall.

16. A braking device according to claim 15 including means for locking the clamp sleeve against turning relative to the second end wall.

17. A braking device according to claim 11 including an manually operable means for pressurizing the fluid in the closed pressure chamber to move the cam member to a release condition.

* * * * *